US006334783B1

(12) United States Patent
Hu

(10) Patent No.: US 6,334,783 B1
(45) Date of Patent: Jan. 1, 2002

(54) ELECTRICAL RECEPTACLE CONNECTOR

(75) Inventor: Snower Hu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/929,746

(22) Filed: Aug. 13, 2001

(30) Foreign Application Priority Data

Mar. 2, 2001 (TW) ..... 90203128 U

(51) Int. Cl.[7] ..... H01R 12/00
(52) U.S. Cl. ..... 439/84
(58) Field of Search ..... 439/78, 84, 544, 439/545, 572

(56) References Cited

U.S. PATENT DOCUMENTS 4,871,320 A * 10/1989 Mouissie ..... 439/78
5,522,730 A * 6/1996 Soes et al. ..... 439/78
5,931,686 A * 8/1999 Sasaki et al. ..... 439/78
5,980,271 A * 11/1999 MacDougall et al. ..... 439/78
6,176,738 B1 * 1/2001 Consoli et al. ..... 439/545

* cited by examiner

*Primary Examiner*—Tulsidas Patel
(74) *Attorney, Agent, or Firm*—Wei Te Chung

(57) ABSTRACT

An electrical connector (1) comprises an insulated housing (2), a number of terminals (3) received in a number of passageways (21) of the insulated housing (2) and a separate spacer (4) which attaches to the housing. The spacer defines a number of through holes (45) each having a configuration of "T" consisted by a wide portion (451) and a narrow portion (453) and corresponding with the passageway. A recess (455) is defined on a bottom of the narrow portion which is far from the wide portion of each through hole and the recess does not run through the spacer. The terminals each are received in the passageway with a pair of shoulders extending from both sides of the connecting portion of the terminal. The shoulders are finally plunged in the recesses to make sure that the terminals will be received in the passageways of the housing without a sliding movement relative to the housing.

17 Claims, 7 Drawing Sheets

ELECTRICAL RECEPTACLE CONNECTOR

BACKGROUND OF THE INVENTION

1. Field of the Invention

The present invention is related to an electrically connector, particularly to an electrical receptacle connector with press-fit terminals which can be firmly fitted on a spacer separated from a housing of the receptacle connector.

2. Description of the Related Prior Art

Terminals with press-fit tail have been horizontally used due to the advantages of steady orientation and causing no breakage to a printed circuit board. U.S. Pat. No. 6,083,060 discloses an electrical connector as shown in FIG. 7 which comprises an insulating housing 11 and a plurality of terminals 12 each having a press-fit tail 125. A bottom of the housing 11 forms a plurality of positioning poles 110 and each pole has a crossed through hole 111. A positioning portion 120 of the terminal 12 has a pair of shoulders 121, a protrusion 123 and an engaging portion 124. In assembly, the terminals 12 are interference fitted in the through holes 111 through the shoulders 121 and the protrusions 123.

However, during inserting the press-fit tail of the terminal 12 into the printed circuit board, the resistance encountered by the printed circuit board will cause the terminal 12 to move along the direction of inserting a mating connector (not shown). Furthermore, if above-mentioned terminals 12 are receptacle terminals, or the engaging portions 124 of the terminals 12 which will be inserted through the through hole 111 are broader than the positioning portion 120, the terminals 12 can not be inserted upwardly into the through hole 111 and position the shoulders 121 in the through hole 111.

Hence, an improved connector assembly is required to overcome the disadvantages of the prior art.

BRIEF SUMMARY OF THE INVENTION

A first object of the present invention is to provide a receptacle electrical connector with a plurality of terminals having a press-fit tail which can be inserted into an insulated housing of the electrical connector upward or downward selectively, and the terminal are secured therein.

To achieve the above-mentioned object, a receptacle electrical connector comprises an insulated housing having a number of passageways, a spacer and a number of terminals received in the insulated housing. The insulating housing having an engaging face and a connecting face. The passageways extend through the engaging face and the connecting face. The spacer has a first face facing the connecting face, an opposite second face and a plurality of though holes corresponding to the passageways, the second face has a pair of recesses in communication with each through hole. Each of the through holes defines a wide portion which is parallel to the recesses and is wider than the shoulders, a narrow portion which is vertical to the recesses and narrower than the shoulders. The shoulders define a width less than a width of the narrow portion plus lengths of the two recesses.

Other objects, advantages and novel features of the invention will become more apparent from the following detailed description of the present embodiment when taken in conjunction with the accompanying drawings.

DETAILED DESCRIPTION OF THE INVENTION

Figure 1:
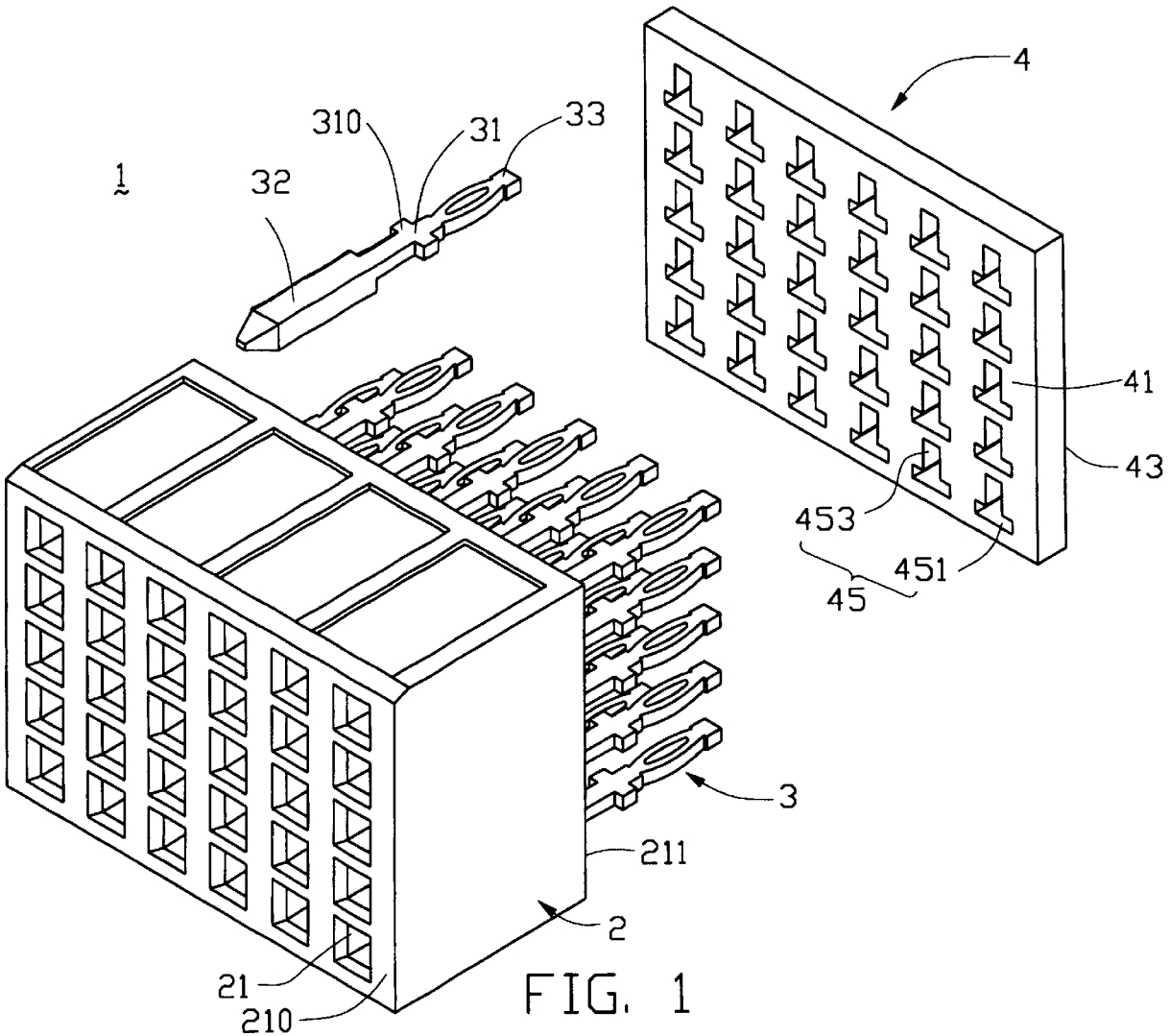
FIG. 1 is an exploded view of a receptacle electrical connector in accordance with the present invention.

Referring to FIG. 1, a receptacle electrical connector 1 in accordance with the present invention comprises an insulating housing 2, a number of terminals 3 received in a number of passageways 21 of the housing 2 and a spacer 4 attached on one side of the housing 2. The housing 2 has an engaging face 210 and a connection face 211, a number of passageways 21 running through the engaging face 210 and the connecting face 211. The connecting face 211 is defined on a surface of the housing 2 facing the spacer 4. The terminals 3 each have an engaging potion 32, a connecting portion (tail portion) 33 and a positioning portion 31 between the engaging portion 32 and the connecting portion 33. The engaging portion 32 is larger than the positioning portion 31 and is received in the passageways 21. A pair of shoulders 310 extends outwardly from two opposite edges of the positioning portion 31. The connecting portion 33 is a press-fit tail which can be inserted into a through hole of a printed circuit board (not shown) correspondingly. The spacer 4 has a first face 41 and a second face 43. The first face 41 is attached to the connecting face 211 of the insulating housing 2 and the second face 43 faces the corresponding printed circuit board with which the electrical connector engages. The spacer 4 also defines a number of through holes 45 corresponding to the passageways 21. The through holes 45 each are T-shaped with a wide portion 451 and a narrow portion 453.

Figure 2:
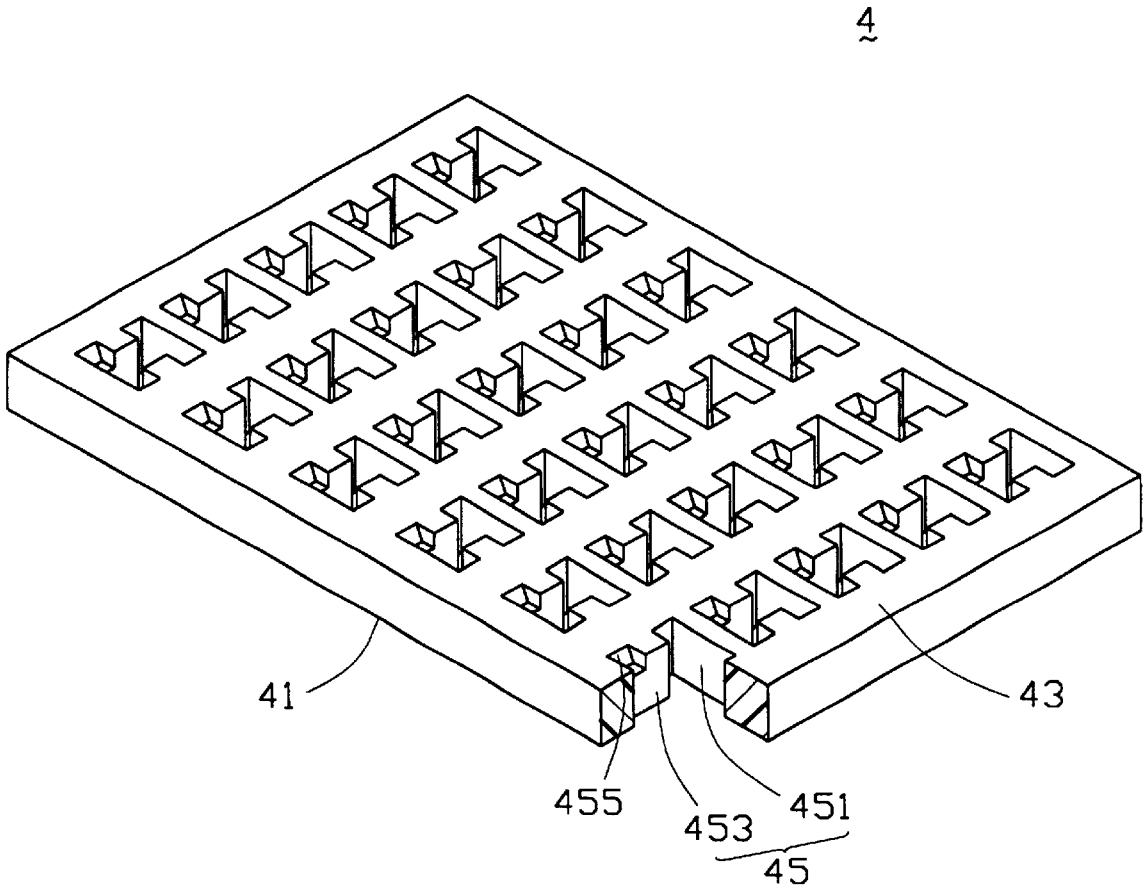
FIG. 2 is a perspective view of a spacer of the receptacle electrical connector in accordance with the present invention.

Referring to FIGS. 1 and 2, the second face 43 defines a pair of recesses 455 in communication with the through hole 45 at the opposite bottom of the narrow portion 453. The recesses 455 are parallel with the wide portion 451. The width and length of the wide portion 451 are greater than those of the shoulder 310 of the terminal 3 to make sure that the shoulder 310 can be received in the recess 455.

Figure 3:
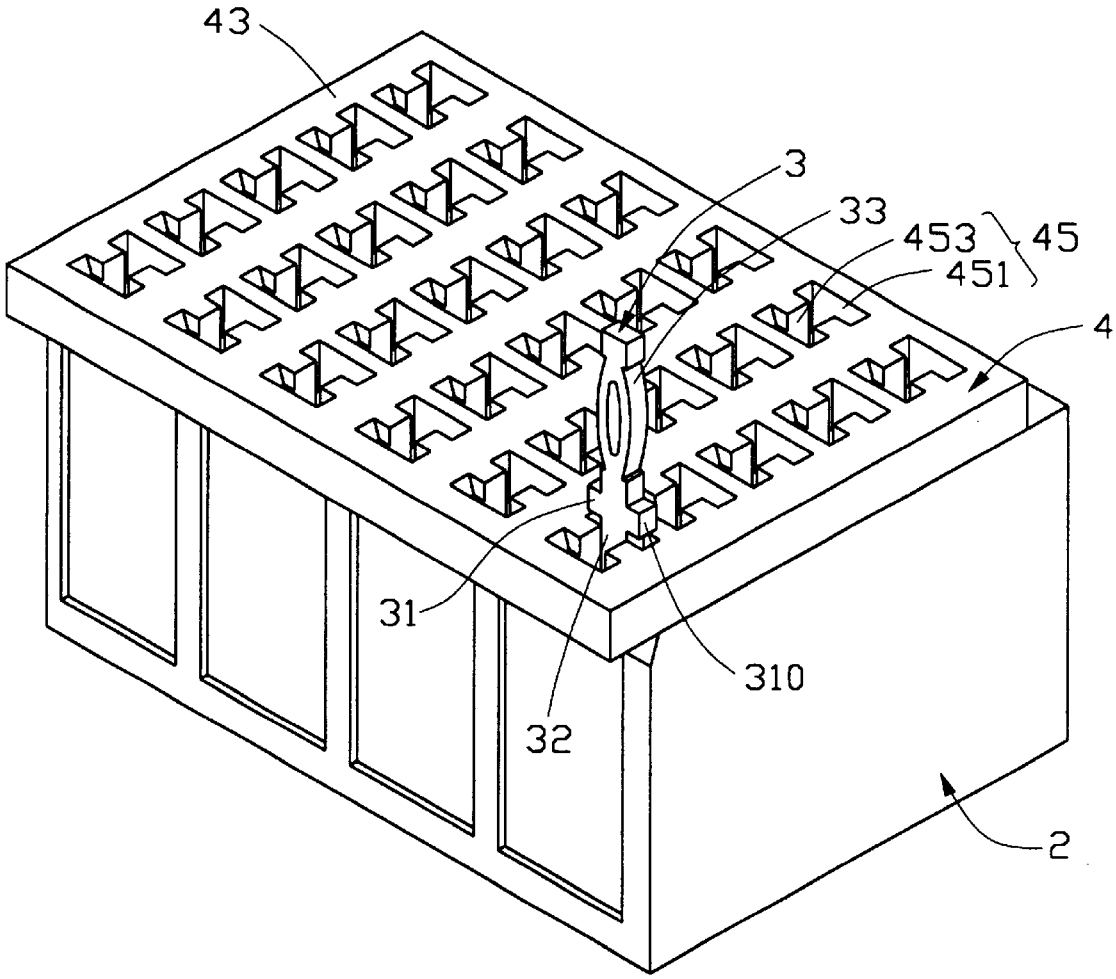
FIG. 3 is a cross sectional view taken along line 3—3 in FIG. 2.

Referring to FIG. 3, in assembly, after the terminal 3 is inserted from the connecting face 211 to the engaging face 210, the engaging portion 32 of the terminal 3 is prepositioned in the passageways 21 of the insulated housing 2. The engaging portion 32 is in the passageway 21 partly and the shoulder 310 is outside the connecting face 211. The connecting portion 33 is inserted through the wide portion 451 of the through hole 45 from the first face 41 to the second face 43 of the spacer 4. When the first face 41 is pressed closely to the connecting face 211 of the housing 2, the shoulders 310 of the terminals 3 extend out of the second face 43.

Figure 4:
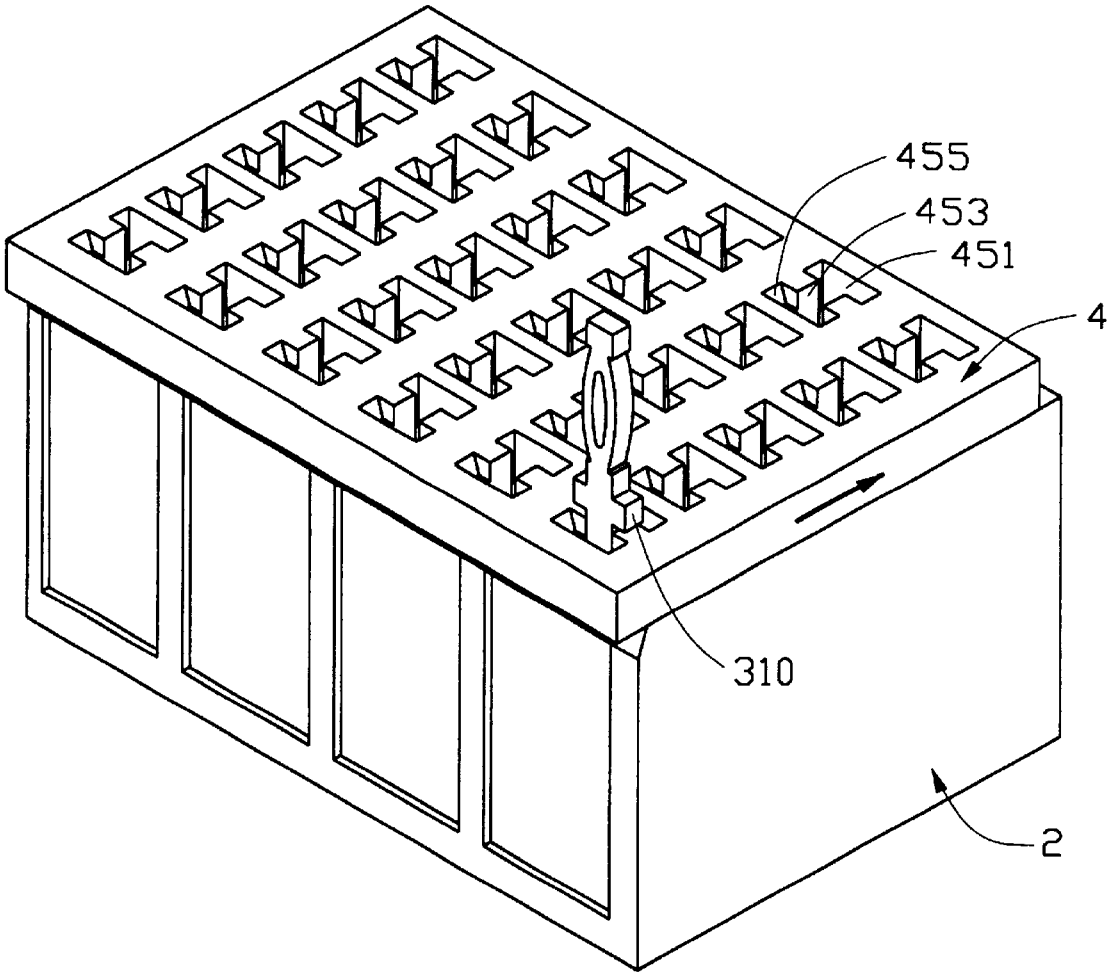
FIGS. 4–6 show progressive positional relationships between the spacer and terminals of the receptacle electrical connector.
Figure 5:
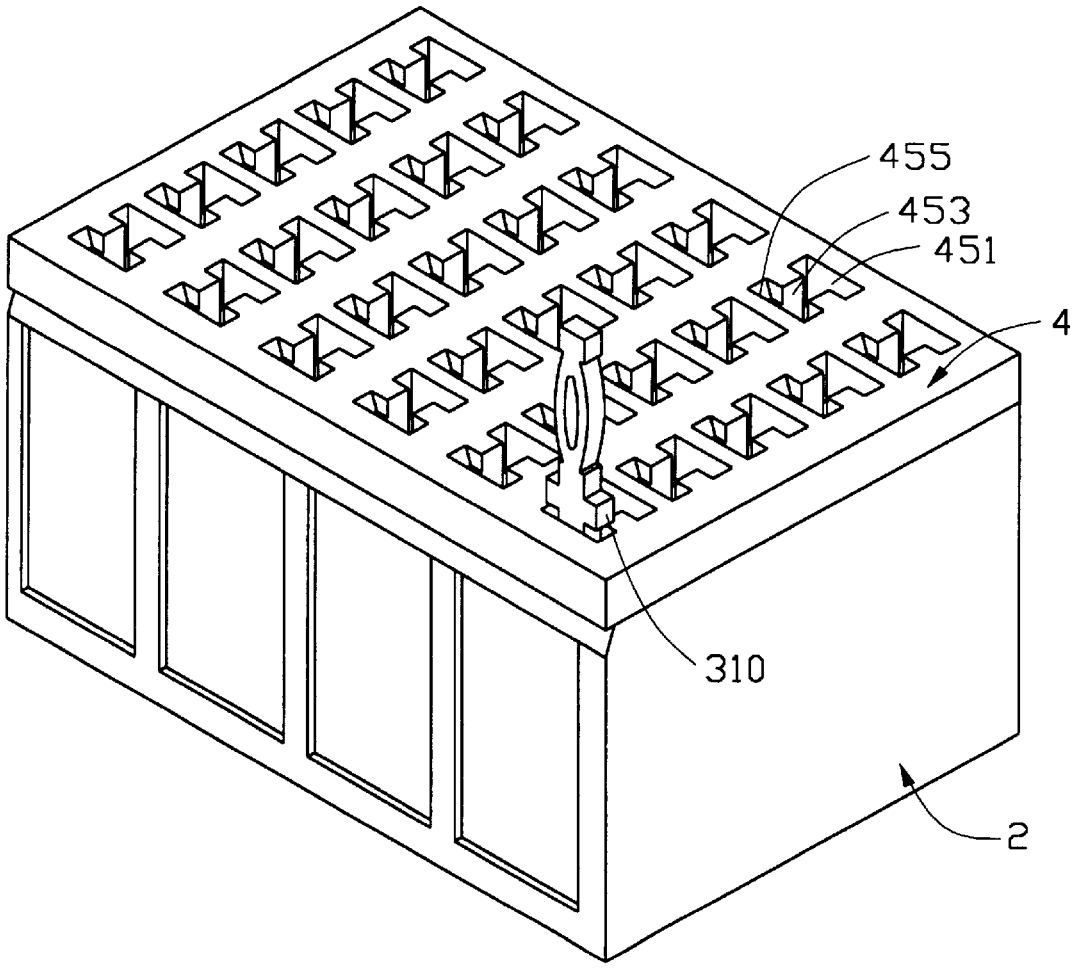

Also referring to FIGS. 4 and 5, while the spacer 4 is shifted along the arrow sign shown in FIG. 4, the engaging portion 32 of the terminal 3 slides along the narrow portion 453 of the through hole 45. When the spacer 4 is positioned correspondingly with the housing 2, the positioning portions 31 and the shoulders 310 are above the recesses 455.

Figure 6:
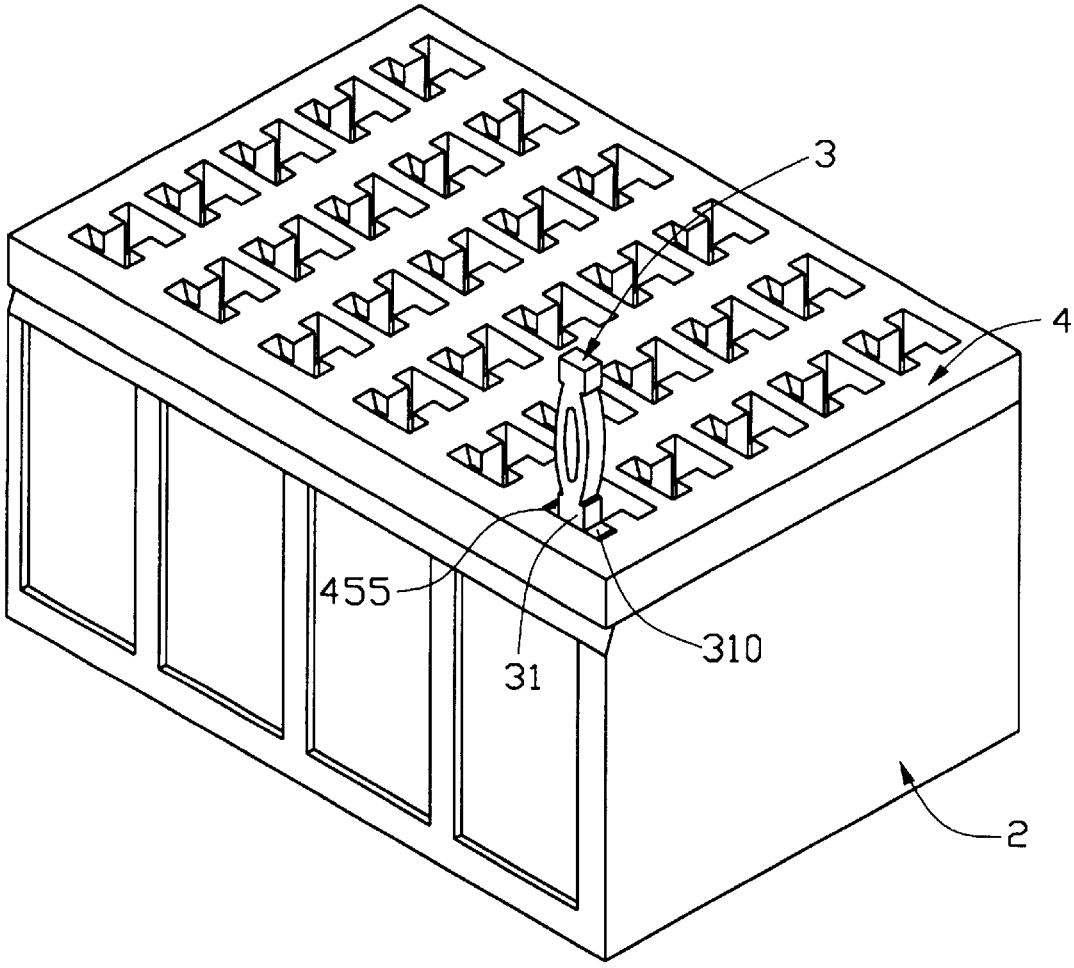
Figure 7:
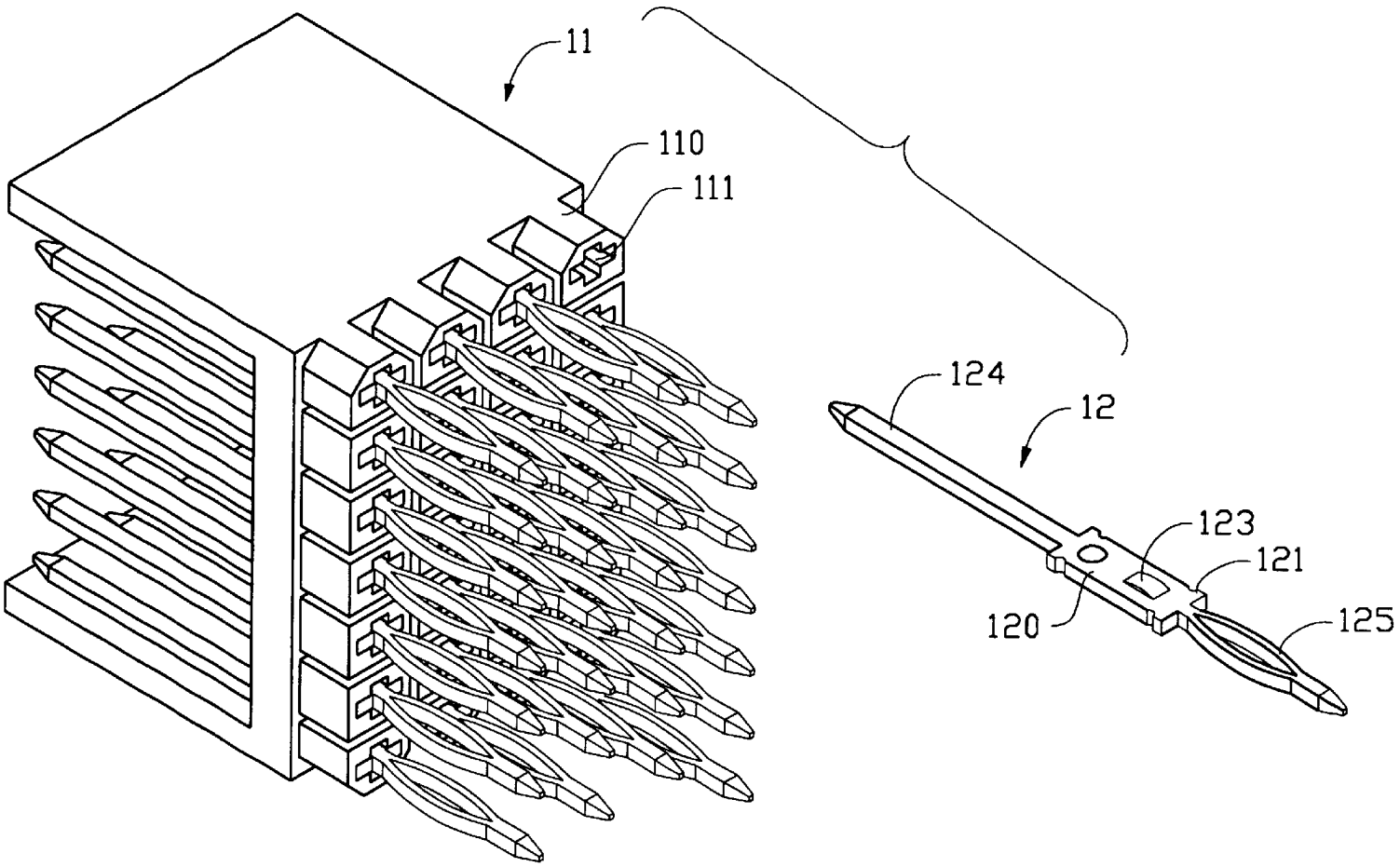
FIG. 7 (PRIOR ART)
FIG. 7 is an exploded view of a receptacle electrical connector of prior art.

Referring to FIGS. 1 and 6, if the terminals 3 are pressed vertically to the second face 43 of the spacer 4, the shoulders 310 of the positioning portion 31 will be plunge into the recesses 455 of the spacer 4. The engaging portion 32 is secured in the passageway 21 and the shoulders 310 will press the spacer 4 to the housing 2 tightly. For the recess 455 is a blind hole, the terminal 3 will not move toward the engaging face 210 even there is a large resistance when the connecting portion 33 is inserted into a through hole of a printed circuit board (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulating housing having an engaging face, a connecting face and a plurality of passageways extending through said engaging face and said connecting face;

a plurality of terminals received in said passageways, each terminal having an engaging portion, a connecting portion and a positioning portion formed between said engaging portion and said connecting portion, said positioning portion having a pair of shoulders; and a spacer having a first face facing said connecting face of said insulating housing, an opposite second face and a plurality of through holes corresponding to said passageways, said second face having a pair of recesses in communication with each said through hole; wherein each said through hole defines a wide portion which is parallel to said recesses and wider than the shoulders, a narrow portion which is vertical to said recesses and narrower than the shoulders, and said shoulders define a width less than a width of the narrow portion plus lengths of the two recesses.

2. The electrical connector as claimed in claim 1, wherein said wide portion has a larger length and width than said shoulders of said terminal.

3. The electrical connector as claimed in claim 2, wherein said recesses are formed on both sides of one end of said narrow portion which is far from said wide portion.

4. The electrical connector as claimed in claim 1, wherein the shoulders extend outwardly from both sides of said positioning portion.

5. The electrical connector as claimed in claim 1, wherein said recesses are blind-holes.

6. The electrical connector as claimed in claim 1, wherein said connecting portion of said terminal is a press-fit tail.

7. The electrical connector as claimed in claim 1, wherein said terminal is either a male contact or a female contact.

8. An electrical connector comprising:

an insulative housing defining engaging and connection faces, respectively;

a plurality of passageways formed in the housing;

a plurality of terminals received within the corresponding passageways, respectively, each of said terminals defining a shoulder around the connection face; and a spacer defining a plurality of through holes; wherein said spacer is assembled to the terminals from the connection face toward the housing, initially in a first direction parallel to the terminals, and successively in a second direction perpendicular to said terminals after the spacer passes the shoulder of the terminals.

9. The connector as claimed in claim 8, wherein each of said through holes defines a T-shaped configuration.

10. The connector as claimed in claim 8, wherein at least a recess is formed in the spacer in communication with the corresponding through hole and receives the shoulder of the corresponding terminal therein.

11. The connector as claimed in claim 8, wherein each of said terminals defines an engaging portion larger than the shoulder.

12. A method of positioning a terminal in a connector, comprising the steps of:

providing an insulative housing with a plurality of passageways;

installing a plurality of terminals into the corresponding passageways, respectively, each of said terminals defining a shoulder around a tail portion thereof;

providing a spacer with a plurality of through holes; and assembling said spacer to the terminals from the tail portions thereof, initially in a first direction parallel to said terminals, and successively in a second direction perpendicular to said terminals after the spacer passes the shoulders of said terminals.

13. The method as claimed in claim 12, wherein said terminals are moved along the first direction after said spacer has moved to its final position in said second direction.

14. The method as claimed in claim 13, wherein the spacer is provided with a recess corresponding to and communicating with each of through holes, thus receiving the shoulder of the corresponding terminals therein.

15. An electrical connector comprising:

an insulative housing with a plurality of terminals therein;

each of said terminals defining a shoulder around a tail portion thereof; and a spacer defining a plurality of through holes each with a wide portion and a narrow portion; wherein the spacer is assembled to the terminals from the tail portion under a condition that the shoulder of each of said terminals extends through the wide portion of the corresponding through hole firstly and spacer moves relative to the housing along a direction defined by the narrow portions of the through holes, secondly.

16. The connector as claimed in claim 15, wherein said spacer further defines a recess in communication with each of said through holes, receiving the shoulder of the correspond terminal.

17. The connector as claimed in claim 16, wherein said recess does not extend through said spacer.

* * * * *